US006293128B1

(12) United States Patent
Leufray-Simms

(10) Patent No.: US 6,293,128 B1
(45) Date of Patent: Sep. 25, 2001

(54) PENDANT REUSABLE ENHANCER FOR NECKLACES

(76) Inventor: Rita Mae Leufray-Simms, 1790 El Sereno Ave., Pasadena, CA (US) 91103

( * ) Notice: Subject to any disclaimer, the term of this patent is extended or adjusted under 35 U.S.C. 154(b) by 0 days.

(21) Appl. No.: 09/369,395

(22) Filed: Aug. 6, 1999

Related U.S. Application Data

(63) Continuation-in-part of application No. 09/002,876, filed on Jan. 5, 1998, now abandoned.

(51) Int. Cl.[7] ..... A44C 25/00
(52) U.S. Cl. ..... 63/23
(58) Field of Search ..... 63/23

(56) References Cited

U.S. PATENT DOCUMENTS

| | | | | |
|---|---|---|---|---|
| 1,028,217 | * | 6/1912 | Jacques | 63/21 |
| 1,624,458 | | 4/1927 | Zook . | |
| 4,265,098 | | 5/1981 | Wayne . | |
| 5,022,237 | | 6/1991 | Monderer et al. . | |
| 5,031,420 | | 7/1991 | Song . | |
| 5,606,874 | | 3/1997 | Archetti et al. . | |
| 5,921,110 | * | 7/1999 | Middendorff et al. | 63/1.11 |

OTHER PUBLICATIONS

"The New Removable Accent" advertisement by David Friedman & Sons, Jewelers' Circular–Keystone, Jul. 1985.*

* cited by examiner

*Primary Examiner*—Anthony Knight
*Assistant Examiner*—Andrea Chop
(74) *Attorney, Agent, or Firm*—William W. Haefliger

(57) ABSTRACT

In jewelry to support a pendant loop below a necklace strand, the combination comprising an upright holder plate having a decorative front side, and a rear side defining upper and lower portions, an upper support loop extending upright above said plate and having two sections which are relatively closable to define a transverse through opening for embracing said necklace strand, above the plate, the support loop connected to the plate upper portion, and a clasp having transversely spaced opposite ends connected to the plate rear side lower portion, and the clasp also having an intermediate portion between said opposite ends disposed to extend through and support the pendant loop to stably hang below the plate, in alignment with the upper support loop, said support loop sections extending in a first and upright plane which is perpendicular to a second plane defined by said plate, the plate having edges generally defining an isocyles triangle which is downwardly divergent to define lower corners proximate said clasp opposite ends, the clasp intermediate portion being downwardly offset so as to stably generally center the pendant loop, said clasp opposite ends concealed behind said plate lower corners, one of said clasp opposite ends having concealed hinge connection to the plate, and the other of said clasp opposite ends having concealed latch connection to the plate.

3 Claims, 2 Drawing Sheets

PENDANT REUSABLE ENHANCER FOR NECKLACES

This application is a continuation-in-part of Ser. No. 09/002,876, filed Jan. 5, 1998 now abandoned.

BACKGROUND OF THE INVENTION

This invention relate generally to improvements in jewelry relating to suspension of pendants as from necklaces, and more particularly concerns novel plate, support loop and clasp apparatus facilitates pendant suspensions from necklaces.

There is continuing need for improvements in jewelry components that enable removable and adjustable supporting of a holder from a necklace, and removable and adjustable suspension of different pendants from such holder, all in a quick and easy manner.

The prior art does not allow for a wide variety of pendant bails, but mainly ring or charm type bails. The prior art includes a mechanical bridge type device and it is not decorative, ornate, or enhancing to the attached pendant drop.

SUMMARY OF THE INVENTION

It is a major object of the invention to provide jewelry apparatus, including components, that meet the above need. Basically, the invention is embodied as a combination of components comprising:

a) an upright holder plate having a decorative front side, and a rear side defining upper and lower portions, b) an upper support loop extending upright above said plate and having sections which are relatively closable to define a transverse through opening for embracing said necklace strand, above the plate, the support loop connected to the plate upper portion, c) and a clasp having transversely spaced opposite ends connected to the plate rear side lower portion, and the clasp intermediate portion between said ends disposed to extend through and support the pendant loop to stably hang below the plate, in alignment with the upper support loop.

Accordingly, the necklace strand is easily positioned to extend through the support loop opening, and a pendant loop is easily attached to the clasp to hang stably, and in alignment with the upper support loops despite locating of the clasp and its opposite ends at rear side of the holder plate, generally concealed from frontal view.

Another object is to locate the support loop section in a first plane which is perpendicular to a second plane defined by said plate, the plate having edges generally defining an isocyles triangle which is downwardly divergent to define lower corners proximate said clasp opposite ends, the clasp having an intermediate portion that is downwardly offset so as to stably generally create the product loop, at first plane. Accordingly, the concealed clasp is transversely accommodated, and supported, for stably supporting and centering the pendant loop whereby the pendant may hang in a selected position below and relative to the necklace.

A further object is to provide one of the support loop sections to be rigidly affixed to a top portion of the plate below which the plate diverges toward said clasp opposite ends. The other of the support loop sections is hingedly attached to the first support loop section, above the top of the plate, and extends rearwardly of the first support loop section, and that other section typically has a lower end that is releasably connectible to lower extent of said one support loop section, and there being a latch to releasably connect said lower end of said other of the support loop sections to said lower extent of said one support loop section.

A yet further object is to provide one of the clasp opposite ends to have latch connection to the plate at said plate rear side lower portion, the clasp extending generally transversely across an upright forwardly extending plate defined by said support loop sections and having means acting to support the pendant loop below said upper support loop. The offset means may be concealed by a downwardly extending portion of the plate.

The present invention enables attachment to necklaces of pendants with a variety of bails, from the small single ring bail, to the small wide rabbit-ear to twin looped bails, and is useful with necklaces that would otherwise not be engaged without an enhancer, such as, necklaces that are thick or wide gauged, as with the byzantine link, or the newer omega styles, and also beads, odd shaped and free form styles.

These and other objects and advantages of the invention, as well as the details of an illustrative embodiment, will be more fully understood from the following specification and drawings, in which:

DRAWING DESCRIPTION

DETAILED DESCRIPTION

Figure 1:
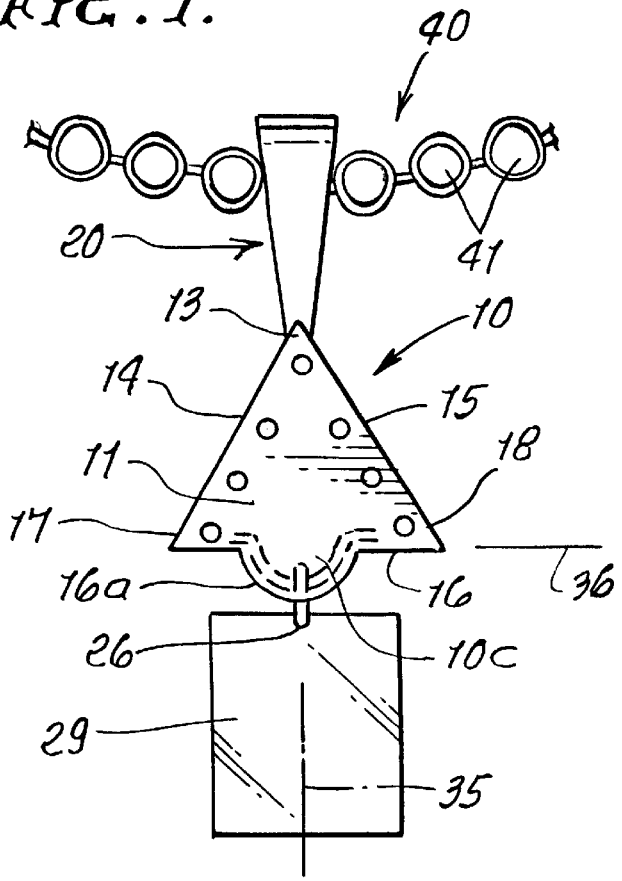
FIG. 1 is a frontal view of preferred jewelry incorporating the invention, and including an upright holder plate, an upper support loop, and a transverse clasp beneath a widened lower portion of the plate, to support and center a pendant loop.
Figure 3:
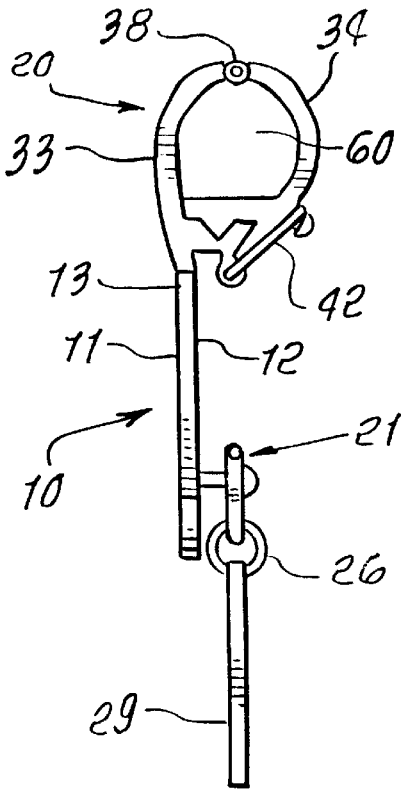
FIG. 3 is a right side view of the FIG. 1 jewelry.
Figure 2:
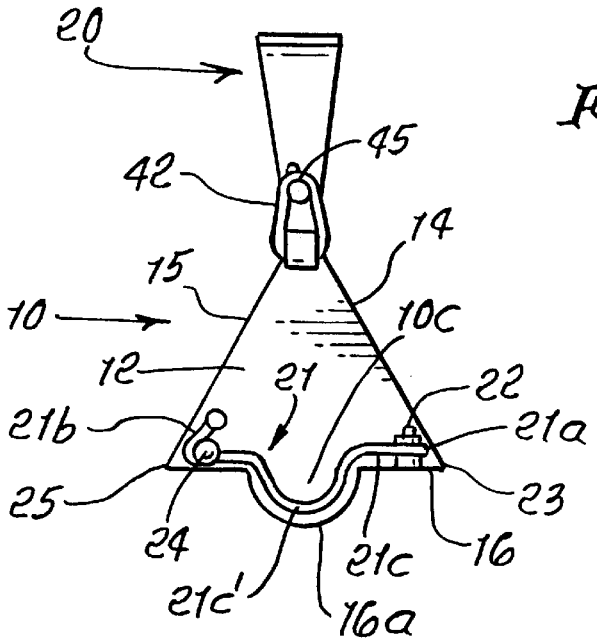
FIG. 2 is a rear view of the FIG. 1 jewelry.

In FIGS. 1–3, an upright holder plate or shield 10 as shown has a decorative front side 11, a flat rear side 12, a narrowed top or crest 13, downwardly divergent edges 14 and 15, and a bottom edge 16. The edge 16 extends between relatively widely spaced corner regions 17 and 18 of the plate, and has a downwardly offset medial portion 16*a* located below and in vertical alignment with the top 13. The plate generally defines an isocyles triangle, and its construction accommodates to an upper support loop 20, and a lower transversely extending clasp or pendant bar component 21.

The clasp 21 has opposite ends 21*a* and 21*b*. As seen in FIG. 2, end 21*a* is hinged at 22 to the rear side of plate 10, near corner 23; and end 21*b* is turned to have releasable frictional or detent connection to a stud 24 protruding from the seat rear side, near corner 25. The clasp intermediate portion 21*c* is transversely elongated, behind the plate, and has a downwardly offset extent 21*c*' extending behind a downwardly extended portion 10*c* of the plate. Therefore, 21*a*, 21*b*, 21*c*, 22 and 24 are concealed behind the plate, which remains decorative.

Figure 7:
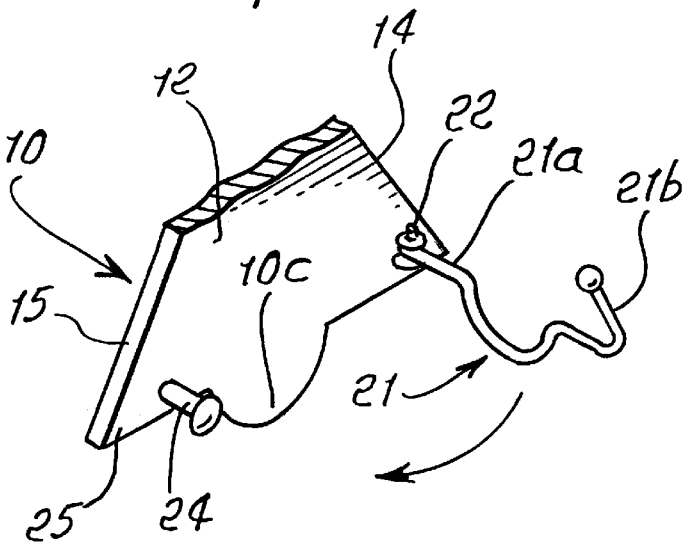
FIG. 7 is a perspective view of the lower rear side of the plate, with a lower clasp opener.
Figure 8:
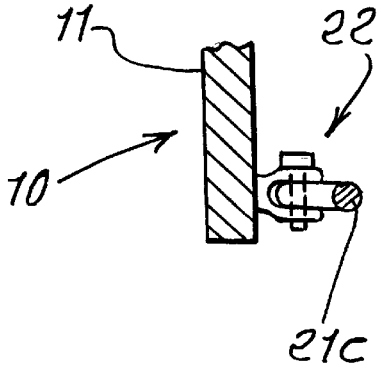
FIG. 8 is a view of clasp hinging.

A pendant loop 26 hangs over 21*c*', and is centered below the plate top or crest 13, whereby the weight of the pendant 29 is stably centered below the upper support loop 20. The clasp can be loosened and swung rearwardly, as seen in FIG. 7, to pass the loop 26, as during connection of a selected pendant to its plate.

The support loop 20 has front and rear sections 33 and 34 that extend in a first plane 35 that is perpendicular to a second plane 36 defined by the plate. Note that pendant loop 26 is stably centered in or closely proximate to plane 35.

Figure 4:
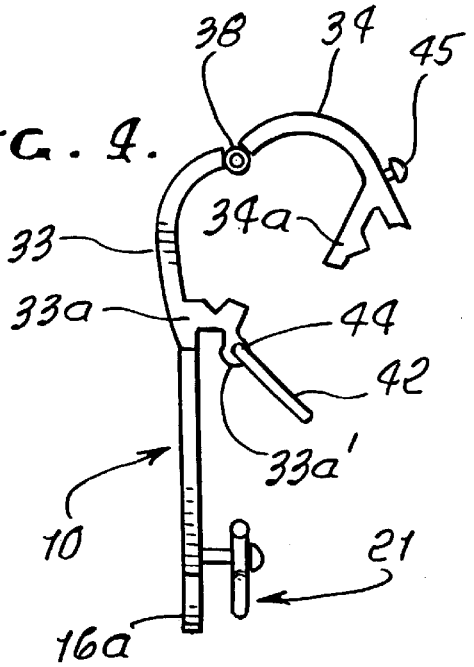
FIG. 4 is a view of the upper support loop as seen in FIG. 3, but opened to receive or remove a necklace.
Figure 5:
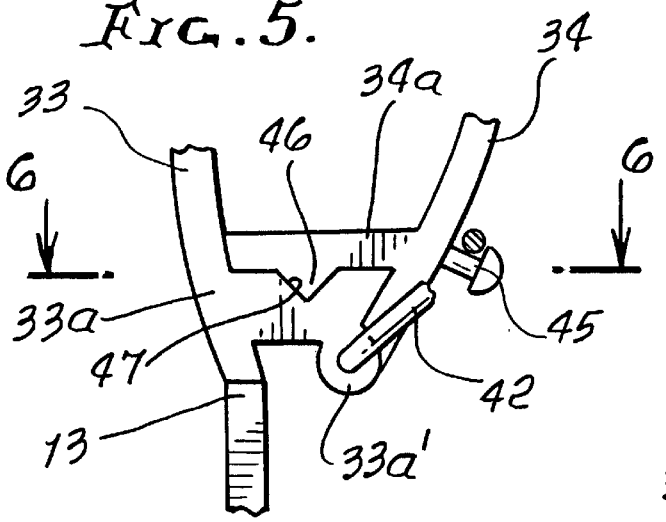
FIG. 5 is an enlarged view like FIG. 4, showing the upper loop closed and latched.
Figure 6:
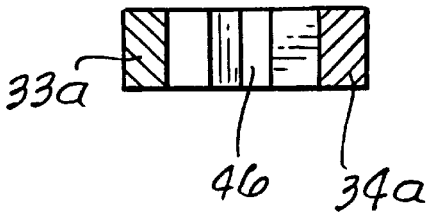
FIG. 6 is a section taken on lines 6—6 of FIG. 5.

One of the support loop sections, such as 33, is rigidly, affixed to top portion 13 of plate 10, that also lies in plane 35. Section 33 may be rearwardly C-shaped as shown, the other section 34 being forwardly C-shaped, and hingedly attached to the top of section 33, as at 38, above the top of the plate. Section 34 extends rearwardly of section 33, to swing rearwardly as seen in FIG. 4, allowing the two sections to embrace the necklace strand 40, which may have beads 41 attached. A through opening is defined at 60. The lower end 34*a* of section 34 has releasable attachment to lower extent 33*a* of section 33. A releasable latch 42 may be provided to establish that connection, and has pivoted connection at 44 to depending 33*a*' and 33*a*. Latch 42 fits over stud 45 on 34*a*. See FIG. 5. Also, a V-shaped tongue 46 on 34*a* snaps into V-shaped notch 47 on 33*a*.

SUMMARY

Jewelry to support a pendant loop 26 below a necklace strand 41, the combination comprises:

a) an upright holder plate 10 having a decorative front side 11, and a rear side 12 defining upper and lower portions, b) an upper support loop 20 extending upright above the plate and having two sections 33 and 34 which are relatively closable to define a transverse through opening for embracing the necklace strand, above the plate, the support loop connected to the plate upper portion, c) and a clasp 21 having transversely spaced opposite ends 21 and 21*b* connected to the plate rear side lower portion, and the clasp also having an intermediate portion 21*a* between the opposite ends 21*a* and 21*b* and disposed to extend through and support the pendant loop to stably hang below the plate, in alignment with the upper support loop, d) the support loop sections extending in a first and upright plane 35 which is perpendicular to a second plane defined by said plate, the plate having edges 14 and 15 generally defining an isocyles triangle which is downwardly divergent to define lower corners 23 and 25 proximate the clasp opposite ends, the clasp intermediate portion being downwardly offset as at 21*c*' so as to stably generally center the pendant loop, e) the clasp opposite ends concealed behind said plate lower corners, one of said clasp opposite ends having concealed hinge connection at 22 to the plate, and the other of said clasp opposite ends having concealed latch connection at 24 to the plate.

Further the plate has a top, and the other of the support loop sections is hingedly attached to the first support loop section, above the top of the plate, and extends rearwardly of the one support loop section.

Yet further, the plate has a lowermost portion 10*c* that extends below the levels of the plate lower corners, and that is in registration with the clasp downwardly offset intermediate portion, to conceal same.

FURTHER SUMMARY

The present invention provides a decorative, ornamental segue, and includes an ornamental pendant type shield has that attached at its apex a hinged bail or loop which opens and closes to attach or detach a necklace. Located at the lower back of the pendant type plate or shield is a pendant bar a clasp which opens and closes to attach or detach a pendant drop.

The jewelry incorporates an enhancer bail, having a vertical and convex arc affixed to the apex of the decorative pendant type shield. A pivot at the top of the convex arc allows a second vertical and convex arc, facing opposite and at the rear of the first act, to be lifted or lowered to either an opened or closed position. At the open position, a necklace of choice is placed between the two arcs and the second arc is lowered to a closed position appending it to the necklace. When closed, the two arcs meet to provide a secure latching mechanism. There is also added extra measure of safety provided by the small safety clasp, that will only latch when the bail is closed correctly.

The hinged pendant bar allows for the placement of a pendant drop of choice to be attached to the pendant support shield. To one side of the shield a pivotal pin allows the horizontal pendant bar to be moved back and forth, to either an open or closed position. In the open position a pendant drop or loop of choice can be placed on the pendant bar and the bar can be swiveled closed, appending the pendant drop to the pendant type shield, thereby making shield and pendant drop one unit, creating decorative enhancement for one another.

I claim:

1. In jewelry for supporting a pendant loop below a necklace strand, the combination comprising a) an upright holder plate having a decorative front side, and a rear side defining upper and lower portions, b) an upper support loop extending upright above said plate and having two sections which are relatively closable to define a transverse through opening for embracing said necklace strand, above the plate, the support loop connected to the plate upper portion, c) and a clasp having transversely spaced opposite ends connected to the plate rear side lower portion, and the clasp also having an intermediate portion between said opposite ends disposed to extend through and support the pendant loop to stably hang below the plate, in alignment with the upper support loop, d) said support loop sections extending in a first and upright plane which is perpendicular to a second plane defined by said plate, the plate having edges generally defining an isocyles triangle which is downwardly divergent to define lower corners proximate said clasp opposite ends, the clasp intermediate portion being downwardly offset so as to stably generally center the pendant loop, e) said clasp opposite ends concealed behind said plate lower corners, one of said clasp opposite ends having a concealed hinge connection to the plate, and the other of said clasp opposite ends having a concealed latch connection to the plate.

2. The combination of claim 1 wherein the plate has a top, and said support loop sections are hingedly attached together above the top of the plate.

3. The combination of claim 2 wherein said plate has a lowermost portion that extends below levels defined by said plate lower corners, and that is in registration with said clasp intermediate portion, to conceal same.

* * * * *